US005718564A

United States Patent [19]

Nocchi

[11] Patent Number: 5,718,564

[45] Date of Patent: Feb. 17, 1998

[54] CENTRIFUGAL PUMP WITH ADAPTOR FOR VARIOUS VALVES

[75] Inventor: Giorgio Nocchi, Cascina, Italy

[73] Assignee: Nocchi Pompe S.P.A., Lugnano, Italy

[21] Appl. No.: 307,616

[22] PCT Filed: Dec. 3, 1992

[86] PCT No.: PCT/IT92/00154

§ 371 Date: Feb. 21, 1995

§ 102(e) Date: Feb. 21, 1995

[87] PCT Pub. No.: WO93/11360

PCT Pub. Date: Jun. 10, 1993

[30] Foreign Application Priority Data

Dec. 5, 1991 [IT] Italy ..... PI/91/A 21

[51] Int. Cl.[6] ..... F04B 49/06

[52] U.S. Cl. ..... 417/44.2; 415/56.2; 137/114; 137/907

[58] Field of Search ..... 417/44.2; 415/56.2, 415/56.5, 56.6, 58.4, 59.1; 137/907, 114, 503, 504, 505

[56] References Cited

U.S. PATENT DOCUMENTS 4,669,495 6/1987 Boyce ..... 137/504

FOREIGN PATENT DOCUMENTS 1381975 11/1964 France .
2044994 2/1971 France .
0297390 4/1917 Germany ..... 415/56.5
967968 12/1957 Germany .
2649033 5/1978 Germany .

OTHER PUBLICATIONS

Philip A. Schweitzer. Handbook Of Valves. (Industrial Press: New York, 1972, pp. 162–163.

*Primary Examiner*—Edward K. Look
*Assistant Examiner*—Xuan M. Thai
*Attorney, Agent, or Firm*—Browdy and Neimark

[57] ABSTRACT

A centrifugal pump is of the type having a diffuser (1) with upstream and downstream ends (1*a*, 1*b*), a delivery body (3) fixed to the downstream end and including a delivery chamber, a suction body (2) fixed to an upstream ends (1*a*) of said diffuser (1) and including a suction chamber. A jacket (8) is fixed between the suction body and said delivery body, defining a space within. The pump includes a multi-functional chamber communicating with said jacket, a first auxiliary outlet communicating between said multi-functional chamber communicating and said suction chamber, a second auxiliary outlet communicating between said multi-functional chamber communicating and the external space, and outlet plugs for opening and closing the two outlets independently of one another. The pump is suitable for different pumping functions.

9 Claims, 2 Drawing Sheets

CENTRIFUGAL PUMP WITH ADAPTOR FOR VARIOUS VALVES

DESCRIPTION

1. Field of the Invention

The present invention is generally related to the pumps field and more precisely relates to a centrifugal water pump having the multiple functions of depth suction, self-priming, pressure adjustment, self-priming with pressure adjustment, automatic start up and shut down.

2. Description of the prior art

At the present time there are known both self-priming centrifugal pumps and depth suction centrifugal pumps.

The first type of these pumps comprises an internal by-pass through which a little share of water circulates backwards from the delivery side to the suction side, thus allowing the pump to be always flooded during the elimination of the air present in the suction pipe. When this air is ended the pressure increases causing a ball valve provided in the by-pass to stop such backflow so as to reduce the pressure drops inside the pump. Other types of self-priming pumps are not provided with the ball valve in the by-pass and reduce the pressure drop due to the permanent internal circulation of water by means of a Venturi tube at the delivery side.

The second type of these pumps comprises a minor delivery outlet through which a share of flow is led to an ejector placed at the suction point (i.e. in a deep well) so as to increase the local pressure and allowing the water to be sucked by the pump in spite of the depth.

Concerning the pressure adjustment, the pumps are provided with external circuits comprising either pressure control valves or flow control valves or speed control devices of the engine.

As concerning the start up and shut down of the engine, the pumps can be provided with automatic devices comprising pressure switches connected with the power supply of the engine of the pump and operating in case of overcoming the pressure limits inside the body of the pump.

The above described pumps are able to solve separately the priming, depth suction, pressure adjustment and automatic shut down and start up problems, but at the present time said features and functions have never been combined.

It is an object of the present invention to provide a centrifugal pump having the multiple functions of depth suction, self-priming, internal pressure adjustment and automatic shut down/start up in case of pressure overcoming maximum limits.

SUMMARY OF THE INVENTION

The above objects are reached by the centrifugal pump according to the invention which has a diffuser engaging with a suction body and a delivery body fixed to the upstream and downstream ends of said diffuser respectively and provided with corresponding suction and delivery chambers. The characteristic of the pump is that said diffuser is housed in a water jacket defined by a spacing case fixed between said bodies and communicating with said delivery chamber. The suction body comprises a multifunctional chamber communicating with the jacket and provided with a first and a second auxiliary outlet communicating with the suction chamber and with the external of the pump respectively. There are provided plugging means engaging in said auxiliary outlets and suitable for different pumping functions.

BRIEF DESCRIPTION OF THE DRAWINGS

Further characteristics and advantages of the pump according to the invention will be made clearer with the following description of a non limiting, exemplifying embodiment, with reference to the attached drawings.

In the drawings.

DESCRIPTION OF THE PREFERRED EMBODIMENT

Figure 1:
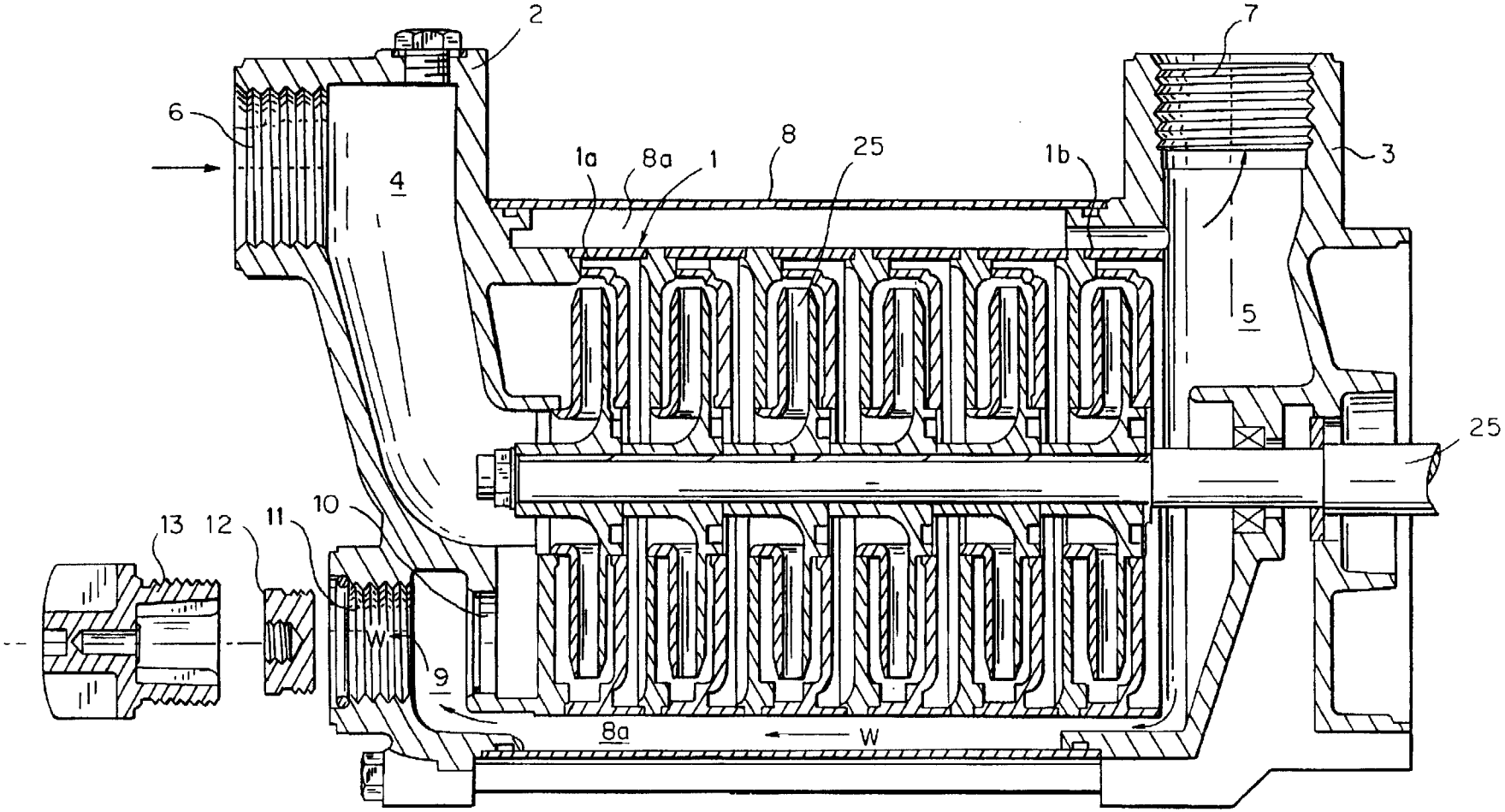
FIG. 1 shows a longitudinal sectional view of a centrifugal pump according to the invention.

With reference to FIG. 1 a centrifugal pump has a diffuser 1 engaging with a rotor 25, a suction body 2 and a delivery body 3 fixed to the upstream and downstream ends 1*a* and 1*b* of said diffuser 1 respectively. Suction body 2 and delivery body 3 are provided with corresponding suction and delivery chambers 4 and 5 respectively as well as a suction inlet 6 and delivery outlet 7.

According to the invention the diffuser 1 is housed in a water jacket 8, defined by a spacing case 8*a* fixed between said bodies 2 and 3, communicating with said delivery chamber 5. The suction body 2 comprises a multifunctional chamber 9 communicating with said jacket 8 and provided with a first and a second auxiliary coaxial threaded outlet 10 and 11, one leading to the outside of the pump and the other to the inside of the pump and in communication with suction chamber 4.

In FIG. 1 are shown plugging means of said outlets 10 and 11 comprising a first plug 12 suitable for being screwed in first outlet 10 and a second plug 13 suitable for being screwed in second outlet 11.

With both first and second outlet 10 and 11 stopped by first and second plug 12 and 13 respectively, the pump operates as a common centrifugal pump with water being sucked from suction chamber 4 and pumped by multistage rotor 25 with increasing pressure at said delivery chamber.

By removing plug 13 and at the same time leaving the plug 12 to stop outlet 10, the water W in chamber 9 flows out of the pump and into a tube leading to an ejector, not shown, working like in a normal depth suction pump.

Figure 2:
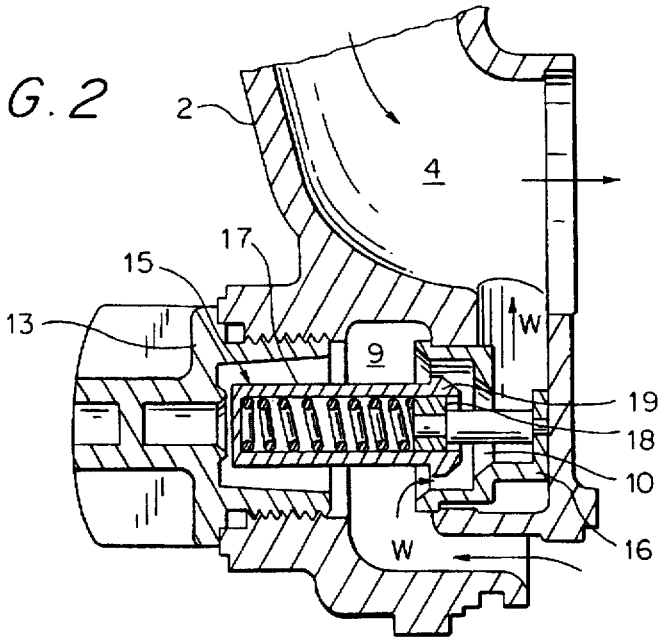
FIG. 2 shows a partial sectional view of a self-priming valve of the pump of FIG. 1.

The pump according to the invention, as shown in FIG. 2, can operate as a self-priming pump through stopping outlet 11 by means of plug 13 and screwing in outlet 10 a valve 15 comprising a bushing 16 and a spring loaded sleeve 17 sliding on a plunger 18 integral to bushing 16. Sleeve 17 has a cap-shaped end 19 suitable for plugging outlet 10 on the side of chamber 9. A self-priming function is performed by the pump by means of valve 15 which, when water is not under pressure, has sleeve 17 in the position shown in FIG. 2. The internal circulation of water W, from delivery chamber to suction chamber 4 through jacket 8 and chamber 9, allows a progressive expulsion through the delivery outlet of the air sucked from suction inlet. When all the air has been expelled and the pump is at a steady working pressure, valve 15 closes due to pressure of water W thrusting on cap-shaped end 19 and leading sleeve 17 to plug outlet 10. In case during steady working of the pump the presence of air would cause a reduction of pressure, sleeve 7 slides backwards allowing water W to internally circulate until a new steady working of the pump is reached after the elimination of the air.

Figure 3:
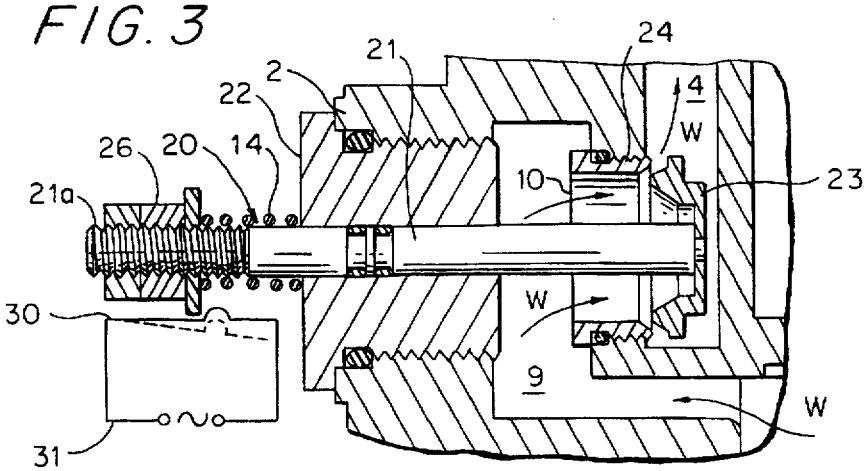
FIG. 3 shows a partial sectional view of a pressure adjustment valve of the pump of FIG. 1.

With reference to FIG. 3, in outlets 10 and 11, a pressure adjustment valve 20 is engaged. Valve 20 comprises a spring loaded shaft 21 slidingly engaged in a hollow plug 22 stopping outlet 11. Shaft 21 is provided with a cap-shaped end 23 engaging with a bushing 24, screwed in first outlet 10, on the side of suction chamber 4. A screw threaded end 21*a* of shaft 21 engages with an adjustment knob 26 compressing a spring 14 against the outer side of hollow plug 22.

Valve 20 is normally closed by a cap-shaped end 23 plugging outlet 10 and the pump works like a normal centrifugal pump without any water W flowing through chamber 9. When the pressure reaches the level limits for which spring 14 is calibrated by adjustment knob 26, shaft 21 slides in the hollow plug 22 causing cap-shaped end 23 to open outlet 10 and allow water W to flow into suction chamber 4. Valve 20 modulates a circulation of water inside the pump inversely proportional to the water being delivered, thus maintaining constant pressure at the delivery side. The less water is required for use, the more the pressure inside the pump increases and the more valve 20 opens to allow circulation to the surplus quantity of water within the pump, thus stabilizing the pressure at the delivery side. When the delivery flow is turned off completely the valve 20 will open accordingly.

Figure 4:
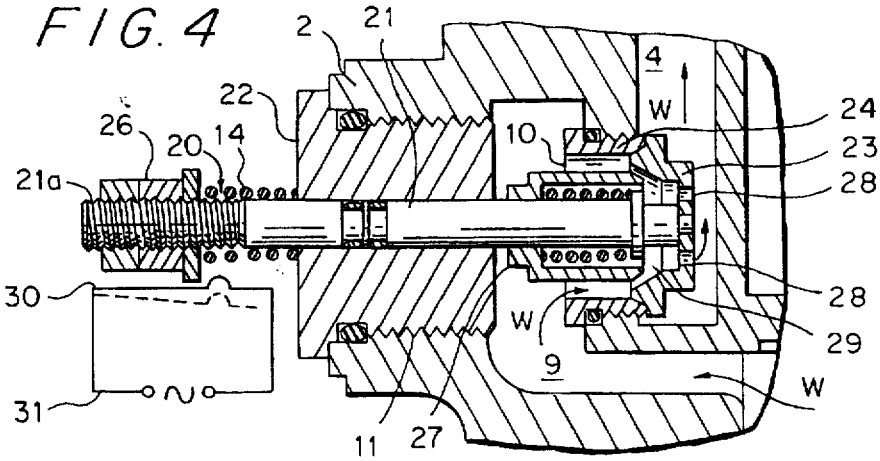
FIG. 4 shows a partial sectional view of a self-priming — pressure adjustment valve of the pump of FIG. 1.

With reference to FIG. 4, according to another embodiment, valve 20 comprises a self-priming shutter 27 which is slidingly coaxially engaged on shaft 21 and in a spring loaded way. Cap-shaped end 23 comprises outlets ports 28 allowing the water W to flow through them when shutter 27 does not stop a chamber 29 defined by cap-shaped end 23. When the pressure of water is low because the pump is in a self-priming condition shutter 27 slides backwards on shaft 21 thus opening chamber 29 and allowing the water W to flow through ports 28 into suction chamber 4. In a steady working of the pump shutter 27 stops chamber 29 without any water W flows. When the pressure overcomes the level limits set by means of knob 26, pressure against cap-shaped end 23 causes shaft 21 to slide in plug 22 thus opening outlet 10 and allowing flow of water W which is circulated to stabilize the pressure.

In case of complete turning off of the delivery water, the circulation would be very high thus causing stress to the rotor and to the whole pump and wasting electric power. For this reason, as shown in FIGS. 3 and 4, an electric switch 30 has been added which operates as start up or shut down of the pump according to the pressure inside the pump which is proportional to the water required. Electric switch 30 opens and/or shuts a power supply circuit 31 of the engine according to the external mechanical movement of shaft 21, which is proportional to the pressure of the water at the delivery outlet. When water at the delivery is not required, pressure increases causing shaft 21 to slide and electrical switch 30 to open supply circuit 31. On the contrary, a demand of delivery water causes a decrease of pressure leading the shaft 21 to slide backwards shutting the supply circuit and starting up the pump engine. The mechanical movement of shaft 21 allows then the use of electrical switch in the place of a more expensive and complex pressure control valve.

The pump according to the invention is therefore suitable for many working functions and in particular allows a combined self-priming, pressure adjustment and startup/shut down of the engine when maximum pressure limits are overcome. In addition no complex devices and external hydraulic circuits are required and a normal working and a depth suction working are possible by using both plugs 12, 13 or only plug 12 to stop outlets 10 and 11 or only outlet 10 respectively.

Variations and/or modifications may be brought to the pump according to the invention without departing from the scope of the invention as found in the appended claims.

I claim:

1. A centrifugal pump comprising a diffuser (1) engaging with a rotor (25), a suction body (2) and a delivery body (3) fixed to upstream and downstream ends (1*a*, 1*b*) of said diffuser (1) respectively and provided with corresponding suction and delivery chambers (4,5), wherein said diffuser (1) is housed in a spacing case (8*a*) defining a jacket (8) fixed between said bodies (2,3) and communicating with said jacket (8), said multifunctional chamber being provided with a first auxiliary outlet and a second auxiliary outlet (10, 11) communicating with said suction chamber (4) and with an external space respectively, said multifunctional chamber including plugging means engaging with said outlets (10, 11) and suitable for different pumping functions;

wherein said plugging means comprises a self-priming valve (15) engaging with a bushing (16) screwed in said first outlet (10) and provided with a spring loaded sleeve sliding on a plunger (18) integral to said bushing (16), said sleeve (17) having a cap-shaped end (19) suitable for stopping said first outlet (10) by engaging with said bushing (16);

wherein said plugging means comprises a pressure adjusting valve (20) comprising a spring loaded shaft (21) slidingly engaged in a hollow plug (22) stopping said second outlet (11), said shaft (21) being provided with a cap-shaped end (23) engaging with said first outlet (10) on the side of said suction chamber (4) and a screw threaded end (21*a*) with which an adjustment knob (26) engages and compresses a spring (14) against the outer side of said hollow stopper (22);

wherein said shaft (21) comprises a coaxial pressure adjustment spring loaded shutter (27) engaging with said cap-shaped end (23), stopping a chamber (29) defined by said shutter and said cap-shaped end, said cap-shaped end having outlet ports (28) communicating with said suction chamber (4); and wherein an electrical switch (30) is provided opening or shutting a power supply circuit (31) of an engine, said switch being mechanically operated by said shaft (21) sliding in said hollow plug (22).

2. In a centrifugal pump contained in an external space, the pump being of the type having a diffuser (1) having an upstream end (1*a*) and a downstream end (1*b*) and engaging with a rotor (25), a delivery body (3) fixed to the downstream end (1*b*) of said diffuser (1) and including a delivery chamber, a suction body (2) fixed to the upstream end (1*a*) of said diffuser (1) and including a suction chamber, and a jacket (8) fixed between said suction body and said delivery body, said jacket defining a spacing case (8*a*) disposed within with said jacket (8);

the improvement comprising:

a multi-functional chamber communicating with said jacket;

a first auxiliary outlet communicating between said multi-functional chamber and said suction chamber;

a second auxiliary outlet communicating between said multi-functional chamber and the external space; and outlet plugging means for opening and closing said first outlet and said second outlet independently of one another;

whereby the pump is suitable for different pumping functions.

3. The improvement according to claim 2, wherein said means for opening and closing said first outlet and said second outlet independently of one another comprises at least one plug having means for mating with an aperture of said multi-functional chamber.

4. The improvement according to claim 3, wherein said means for being opening and closing said first outlet and said second outlet independently of one another comprises:

a first auxiliary outlet plug mating a with smaller aperture of said multi-functional chamber; and a second auxiliary outlet plug mating a with larger aperture of said multi-functional chamber; and wherein said larger aperture is greater in diameter than said first auxiliary outlet plug.

5. The improvement according to claim 4, wherein said first auxiliary outlet plug comprises a self-priming valve (15) engaging with a bushing (16) screwed in said first outlet (10) and provided with a spring loaded sleeve (17) sliding on a plunger (18) integral to said bushing (16), said sleeve (17) having a cap-shaped end (19) suitable for stopping said first outlet (10) by engaging with said bushing (16).

6. The improvement according to claim 5, wherein said spring is adjustable in length.

7. The improvement according to claim 4, wherein said plugging means comprises a pressure adjusting valve (20) comprising a spring loaded shaft (21) slidingly engaged in a hollow plug (22) stopping said second outlet (11), said shaft (21) being provided with a cap-shaped end (23) engaging with said first outlet (10) on the side of said suction chamber (4) and a screw threaded end (21*a*) with which an adjustment knob (26) engages and compresses a spring (14) against the outer side of said hollow stopper (22).

8. The improvement according to claim 7, wherein said spring is adjustable in length.

9. The improvement according to claim 3, wherein said means for engaging includes plug screw threads matable with corresponding threads of said multi-functional chamber.

* * * * *